US008939816B2

(12) United States Patent
Chen

(10) Patent No.: US 8,939,816 B2
(45) Date of Patent: Jan. 27, 2015

(54) HANDHELD PNEUMATIC GRINDER WITH ADJUSTABLE WHEEL GUARD STRUCTURE

(75) Inventor: Lung-Pao Chen, Zhubei (TW)

(73) Assignee: Sunmatch Industrial Co., Ltd., Hsinchu County (TW)

( * ) Notice: Subject to any disclaimer, the term of this patent is extended or adjusted under 35 U.S.C. 154(b) by 429 days.

(21) Appl. No.: 13/539,507

(22) Filed: Jul. 2, 2012

(65) Prior Publication Data

US 2014/0004778 A1 Jan. 2, 2014

(51) Int. Cl.
*B24B 55/05* (2006.01)

(52) U.S. Cl.
USPC ..... 451/359

(58) Field of Classification Search
USPC ..... 451/344–359; 24/591.1, 593.3, 594.1; 292/128, 228, 209, 280, 210, 101–103, 292/107, 108, 202–204
See application file for complete search history.

(56) References Cited

U.S. PATENT DOCUMENTS

| | | | | | |
|---|---|---|---|---|---|
| 120,334 | A * | 10/1871 | Shaw | 292/280 |
| 585,605 | A * | 6/1897 | Ullin | 292/280 |
| 722,754 | A * | 3/1903 | Riley | 292/280 |
| 2,754,128 | A * | 7/1956 | Schramm | 280/43.18 |
| 2,801,868 | A * | 8/1957 | Carson | 292/202 |
| 4,924,635 | A | 5/1990 | Rudolf et al. | |
| 5,766,062 | A * | 6/1998 | Edling | 451/451 |
| 6,981,538 | B2 * | 1/2006 | English | 160/7 |
| 7,458,882 | B2 * | 12/2008 | Izmailov | 451/344 |
| 7,892,075 | B2 | 2/2011 | Esenwein | |
| 8,282,446 | B2 * | 10/2012 | Sulea et al. | 451/451 |
| 8,454,411 | B2 * | 6/2013 | Boeck et al. | 451/344 |
| 2009/0311953 | A1 * | 12/2009 | Maute et al. | 451/359 |
| 2010/0178857 | A1 * | 7/2010 | Esenwein | 451/359 |
| 2011/0195643 | A1 * | 8/2011 | Dai | 451/359 |
| 2012/0108154 | A1 * | 5/2012 | Nakamura et al. | 451/451 |

* cited by examiner

*Primary Examiner* — Lee D Wilson
*Assistant Examiner* — Henry Hong
(74) *Attorney, Agent, or Firm* — Leong C. Lei

(57) ABSTRACT

A handheld pneumatic grinder comprises a main body, a transmission portion, and a wheel guard structure. The main body defines an active space. The transmission portion is provided on the main body. The wheel guard structure includes a coupling member, a protective hood, and a control member. The coupling member is coupled to the main body around the transmission portion. The protective hood is rotatably mounted to the coupling member at a center thereof, wherein the protective hood is provided with an engagement means defining a plurality of indentations. The control member has a protrusion, which can engage with one of the indentations of the engagement means to allow the protective hood to be fixed in an angle position. The present invention allows the protective hood to be adjusted without using an external tool, and can achieve a compact design.

8 Claims, 10 Drawing Sheets

HANDHELD PNEUMATIC GRINDER WITH ADJUSTABLE WHEEL GUARD STRUCTURE

TECHNICAL FIELD OF THE INVENTION

The present invention relates to a handheld grinder and, more particularly, to a handheld pneumatic grinder, whereby the angle position of the protective hood can be adjusted without using an external tool, and the grinder can be applied in a working site having small space.

DESCRIPTION OF THE PRIOR ART

As shown in FIGS. 1 and 1A, a conventional handheld grinder comprises a main body 41, a handle 4, and a transmission portion 42, which is driven through a direction converter consisting of bevel gears within the transmission portion 42. For safety, a protective hood 43 is usually provided and mounted around the transmission portion 42.

In use, a grinding wheel (not shown) is mounted to the transmission portion 42, and then can be driven into rotation through an input axle in the handle 4. For protecting a user from being damaged due to breakage of the grinding wheel, the protection hood 43 is mounted around the transmission portion 42 by using a clamp and a screw.

However, to adjust the protective hood 43, an external tool 44 is required to loosen the clamp, so that the protective hood 43 can be rotated to a desired angle, and this is inconvenient. As to other types of grinders, although they are provided with an adjustable hood, they are large and complicated in structure. For application in a narrow space, they are inconvenient.

Although U.S. Pat. Nos. 4,924,635 and 7,892,075 disclosed a protective hood that can be adjusted without using an external tool, they are large in structure and thus are difficult to be used in a working site having small space.

In view of the existing grinders, there is a need to provide a grinder that includes an adjustable hood without using external tool and is compact in structure.

SUMMARY OF THE INVENTION

The primary object of the present invention is to provide a handheld pneumatic grinder, whereby the angle position of the protective hood can be adjusted without using an external tool, and the grinder can be applied in a working site having small space.

To achieve the above purpose, the handheld pneumatic grinder may comprise a main body, a transmission portion, and a wheel guard structure. The main body defines an active space. The transmission portion is provided on the main body. The wheel guard structure includes a coupling member, a protective hood, and a control member. The coupling member is coupled to the main body around the transmission portion. The protective hood is rotatably mounted to the coupling member at a center thereof, wherein the protective hood is provided with an engagement means defining a plurality of indentations, and allowed to be rotated about the coupling member at a predetermined angle. The control member has a protrusion which can engage with one of the indentations of the engagement means, the control member including a slanted end portion located in the active space of the main body, the slanted end portion being insertedly connected to one end of a connecting pin located in the active space of the main body, the other end of the connecting pin being affixed to the main body, the connecting pin being fitted with a bush between its two ends and a coil spring around the bush, whereby the control member can cooperate with the coil spring and the bush to allow the protective hood to be fixed at an angle position when the control member is in normal condition, and to allow the control member to be tilted about the bush by a user to allow the control member to be clear of the engagement means, so that the protective hood can be rotated about the coupling member.

In operation, the user can is required to depress the operation portion of the control member by one hand. Meanwhile, the protective hood can be rotated by the other hand. After the protective hood is rotated to a desired angle position, the user may release the operation portion of the control member to allow the control member to be engaged with the engagement means of the protective hood again, so that the protective hood can be fixed again. The present invention allows the protective hood to be adjusted without using an external tool, and can achieve a compact design.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
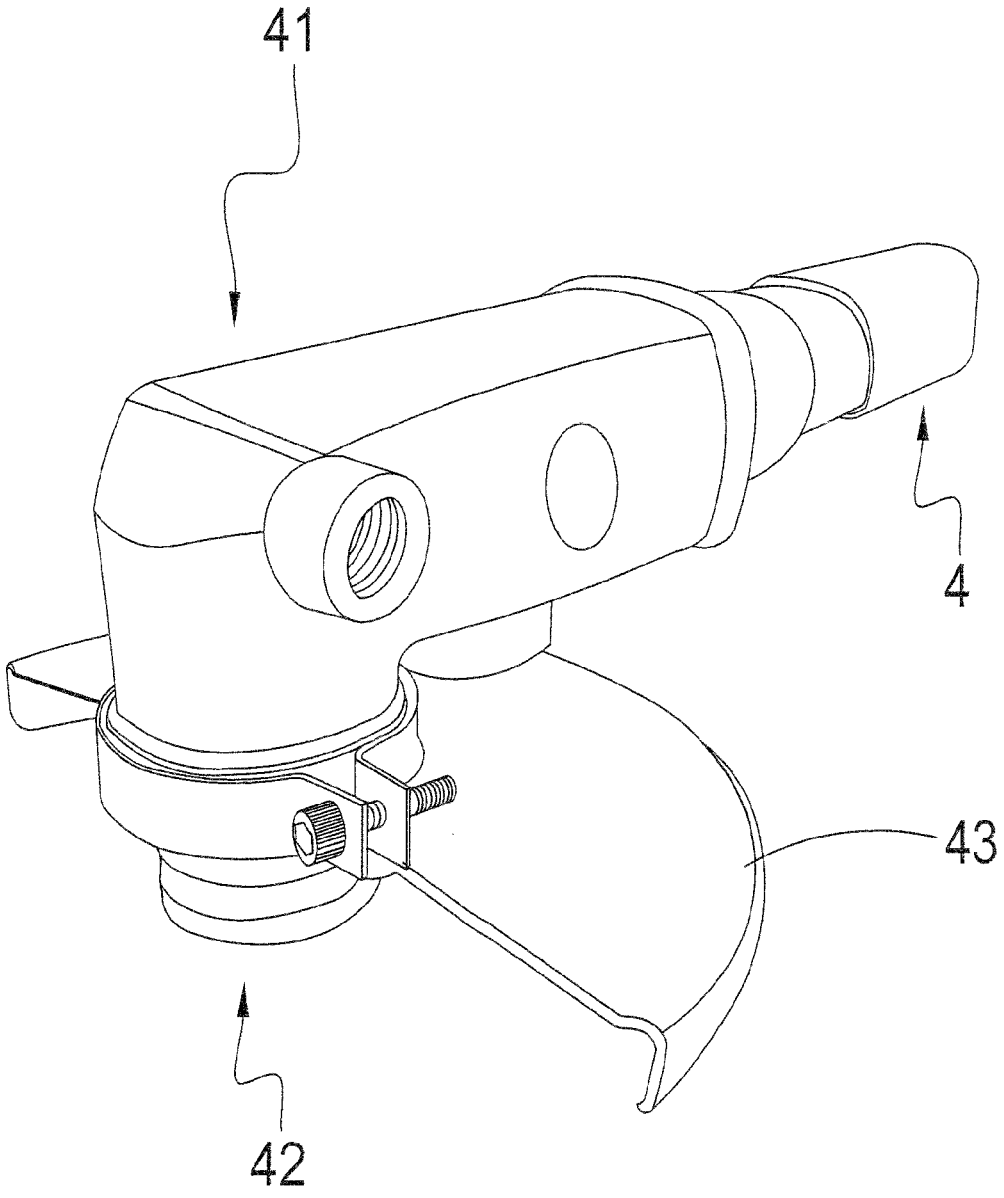
FIG.1 PRIOR ART
FIG. 1 shows a 3-dimensional view of a conventional handheld grinder.
Figure 1A:
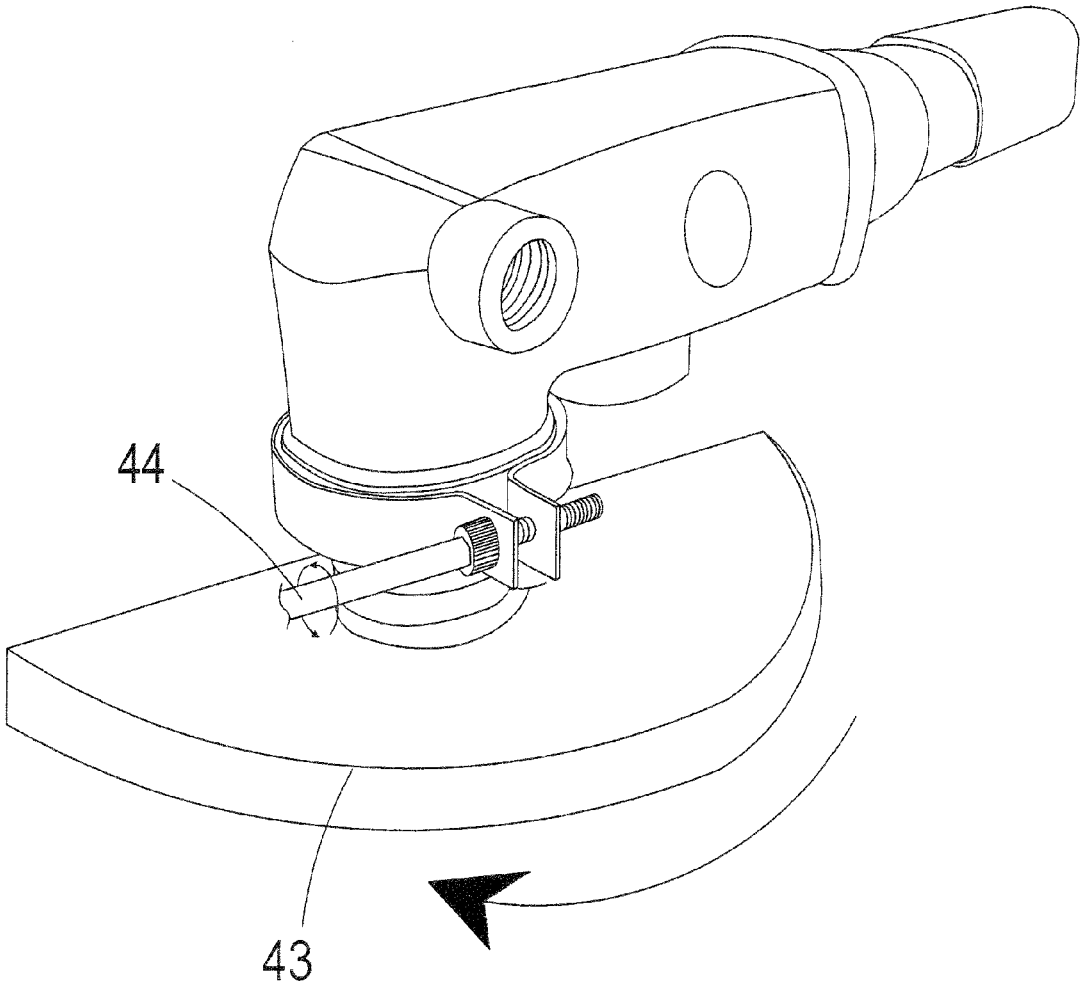
FIG.1A PRIOR ART
FIG. 1A shows another 3-dimensional view of the conventional handheld grinder.
Figure 2:
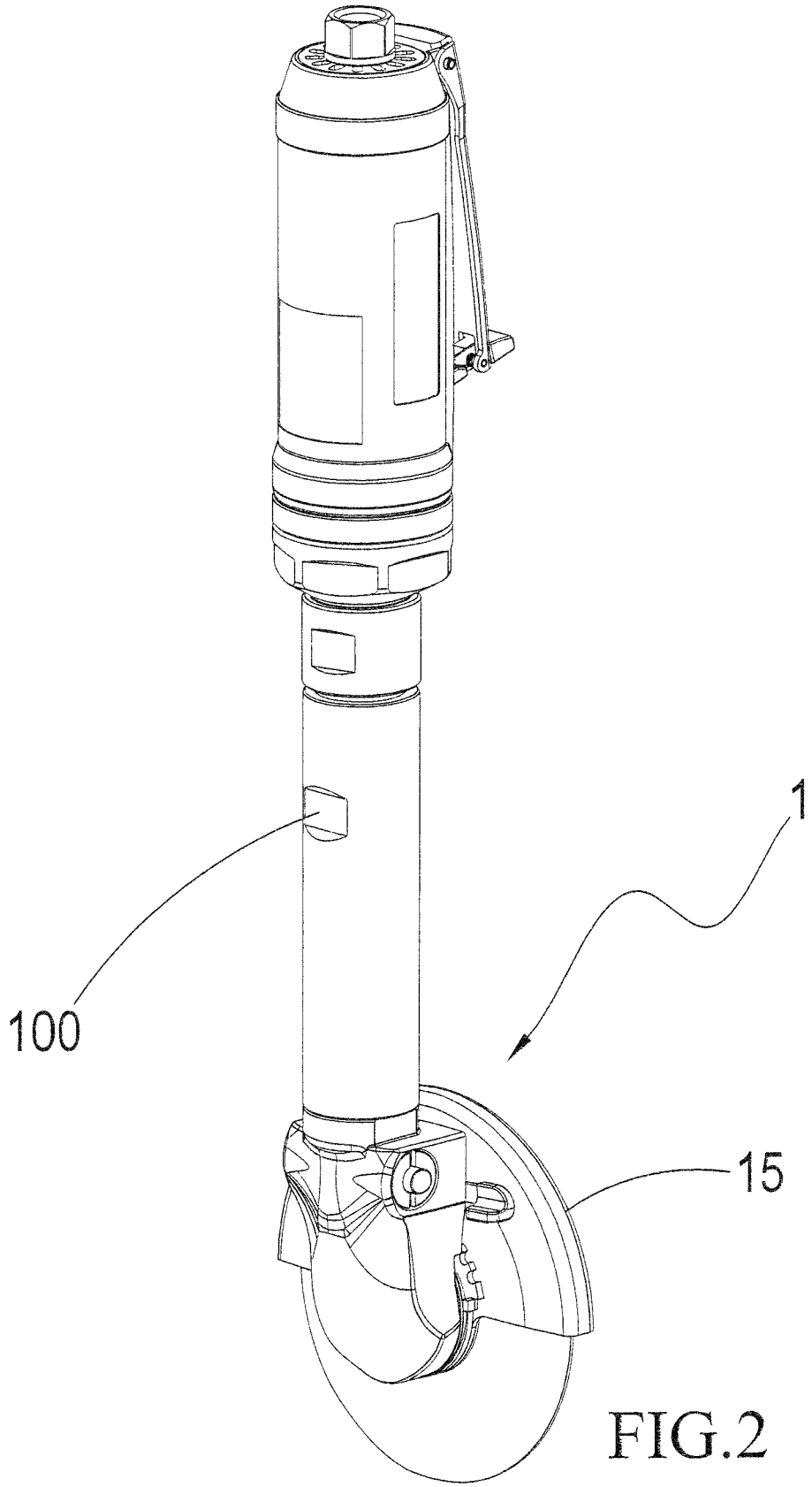
FIG. 2 shows a 3-dimensional view of one embodiment of the present invention.
Figure 3:
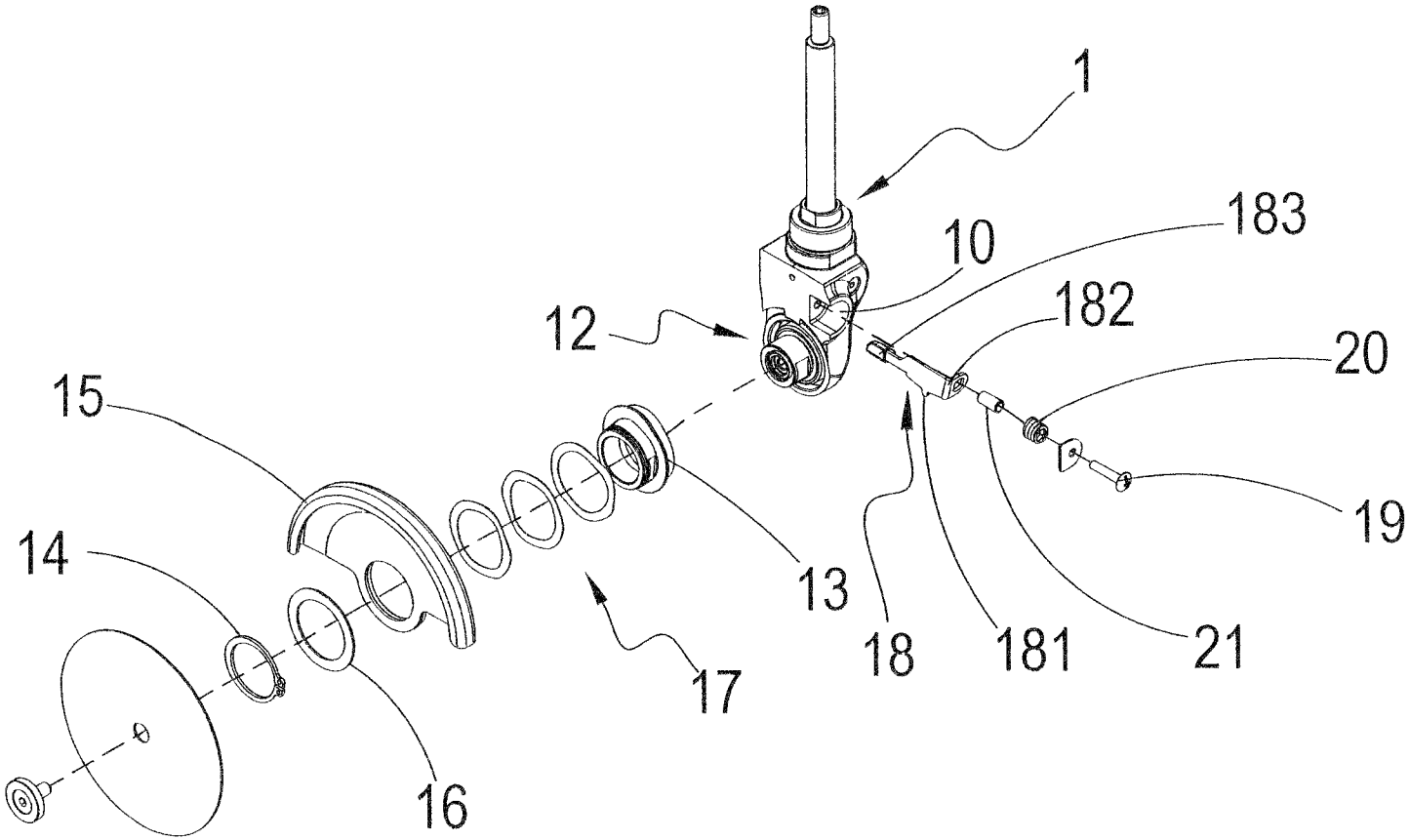
FIG. 3 shows an exploded view of the embodiment of the present invention.
Figure 4:
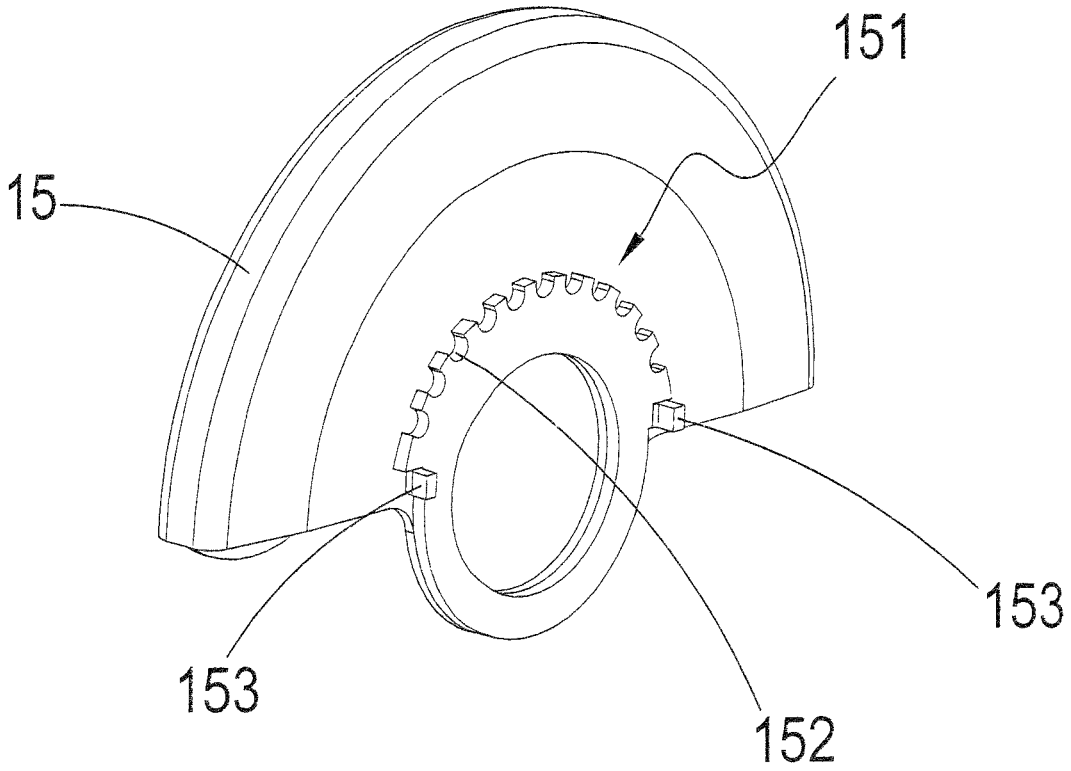
FIG. 4 shows a 3-dimensional view of a protective hood of the embodiment of the present invention.
Figure 5:
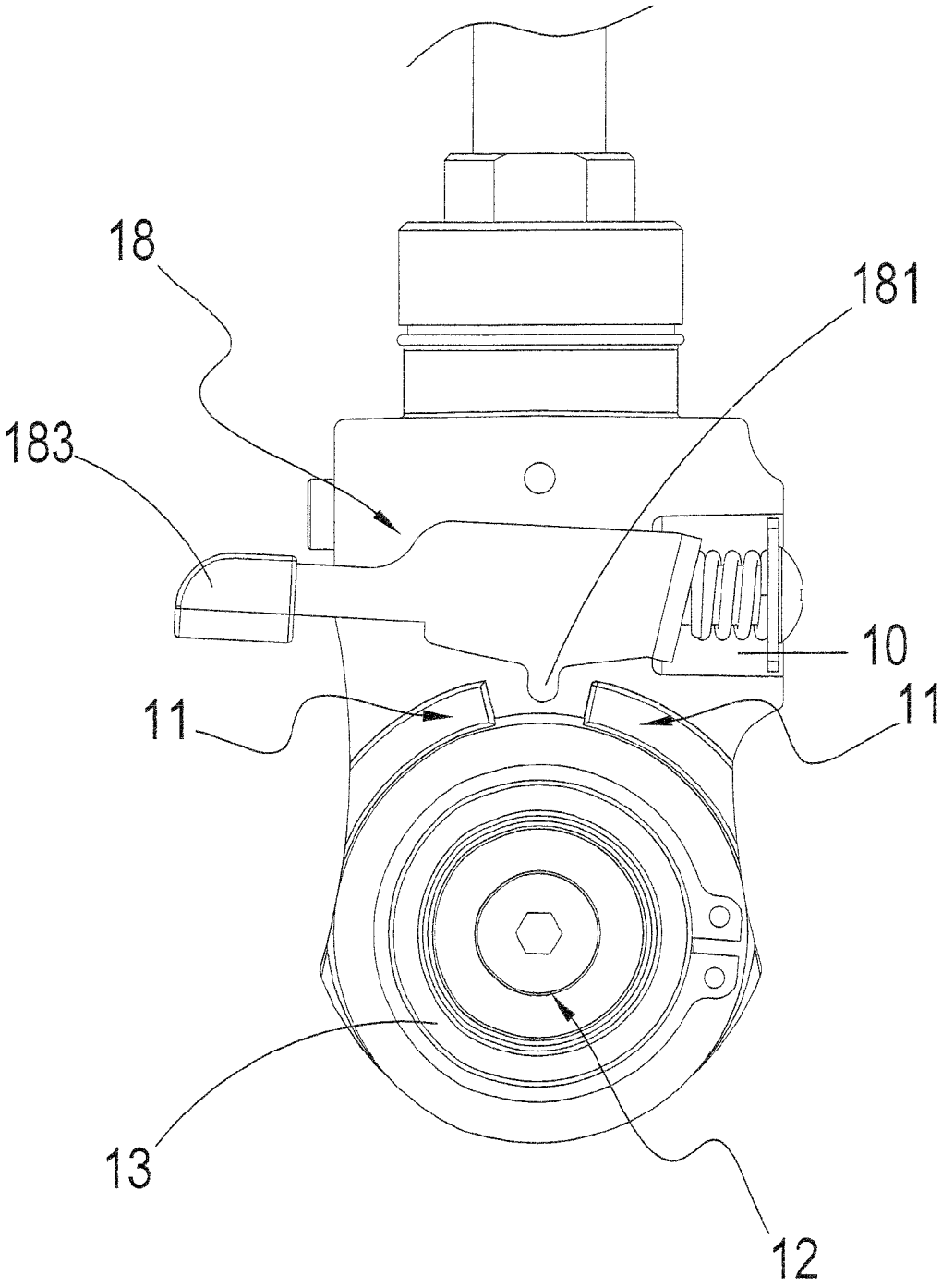
FIG. 5 shows a plan view of the embodiment of the present invention.

Referring to FIGS. 2-5, a handheld pneumatic grinder according to one embodiment of the present invention generally comprises a main body 1, a transmission portion 12, and a wheel guard structure including a coupling member 3, a protective hood 15, and a control member 18.

The main body 1 defines an active space 10 and is provided with a button 100 for starting the grinder. The transmission portion 12 is provided on the main body 1. The coupling member 13 is coupled to the main body 1 around the transmission portion 12. Also, the main body 1 defines a slot 11, near to the transmission portion 12, for cooperating with the protective hood 15, so that rotation of the protective hood 15 can be limited in a range, as will be fully illustrated later.

A snap ring 14 is further provided for holding the protective hood 15 onto the coupling member 13 that is coupled to the main body 1. Also, the present invention provides at least one first washer 16 between the snap ring 14 and the protective hood 15 to improve the connection.

The protective hood 15 is rotatably mounted to the coupling member 13 at a center thereof, wherein the protective hood 15 is provided with an engagement means 151 defining a plurality of indentations, and allowed to be rotated about the coupling member 13 at a predetermined angle. In particular, the engagement means 151 is formed into an arcuately toothed member substantially at the center of the protective hood 15, wherein the arcuately toothed member is formed with a plurality of teeth 152. The control member 18 is capable of engaging with the engagement means or arcuately toothed member 151, as will fully illustrated in the following paragraphs. The engagement means or arcuately toothed member 151 includes at least one protrusion 153 which can engage with two sides of the slot 11 of the main body 1. With such features, rotation of the protective hood 15 can be limited in a range. Also, the present invention provides at least one second washer 17, made of resilient material, between the engagement means 151 of the protective hood 15 and the coupling member 13 to improve the connection.

The control member 18 has a protrusion 181, which can engage with one of the indentations between the teeth 152 of the engagement means or arcuately toothed member 151. Also, the control member 18 includes an end portion 182 located in the active space 10 of the main body 1, wherein the end portion 182 is insertedly connected to one end of a connecting pin 19 located in the active space 10 of the main body 1; the other end of the connecting pin 19 is affixed to the main body 1; the connecting pin 19 is fitted with a bush 21 between its two ends and a coil spring 20 around the bush 21. As such, the control member 181 can cooperate with the coil spring 20 and the bush 21 to allow the protective hood 15 to be fixed at an angle position when the control member 18 is in normal condition, and to allow the control member 18 to be tilted about the bush 21 by a user to allow the control member 18 to be clear of the engagement means or arcuately toothed member 151, so that the protective hood 15 can be rotated about the coupling member 13. Preferably, the end portion 182 of the control member 18 is shaped to have a slanted end surface, which urges against the coil spring 20, to facilitate the control member 18 to be engaged with the engagement means or arcuately toothed member 151 when the control member 18 is in normal condition. Also, the control member 18 includes an operation portion 183, being located opposite to the end portion 182, to be depressed by a user.

Figure 6:
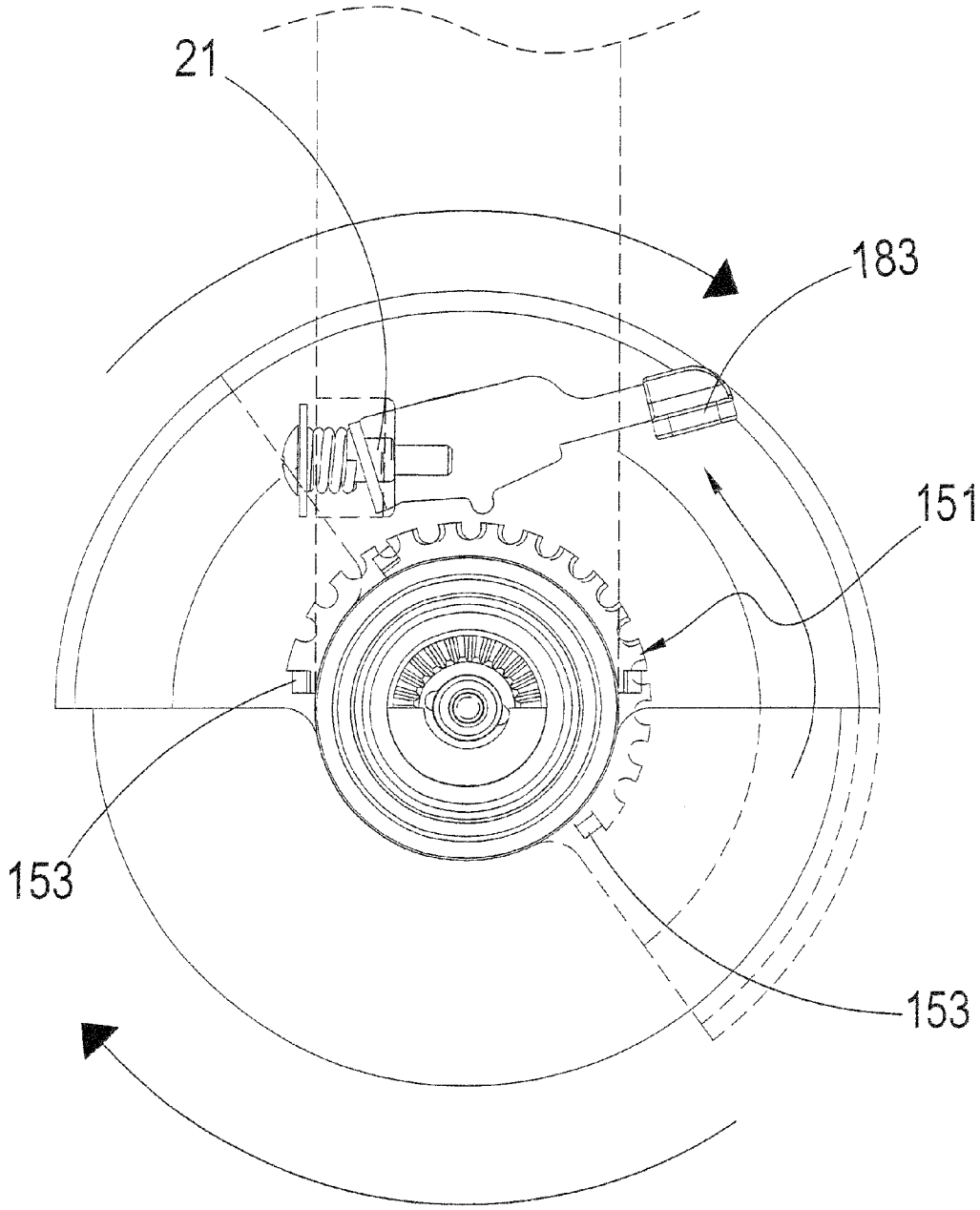
FIG. 6 shows a working view of the embodiment of the present invention.
Figure 6A:
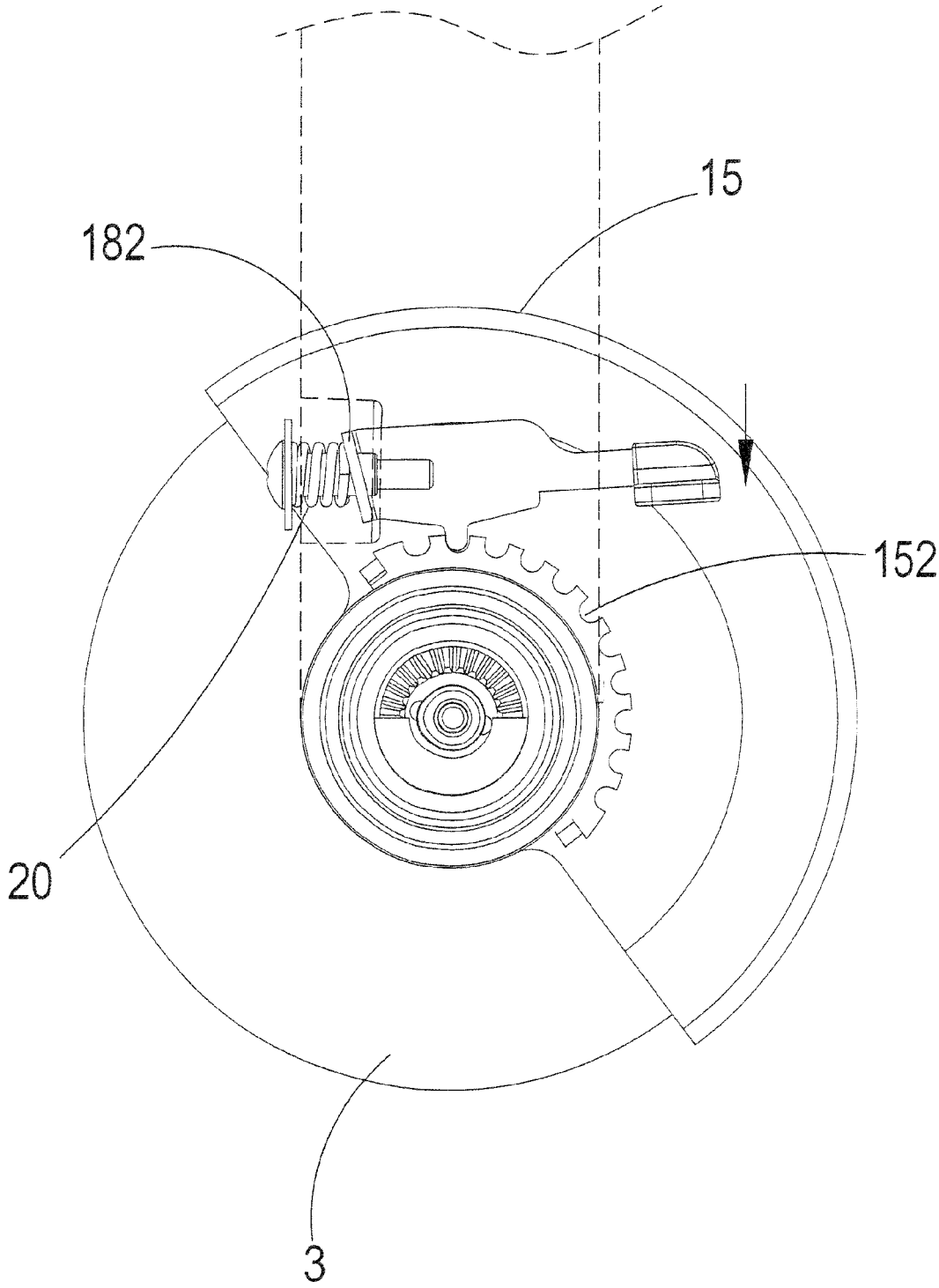
FIG. 6A shows a second working view of the embodiment of the present invention.
Figure 7:
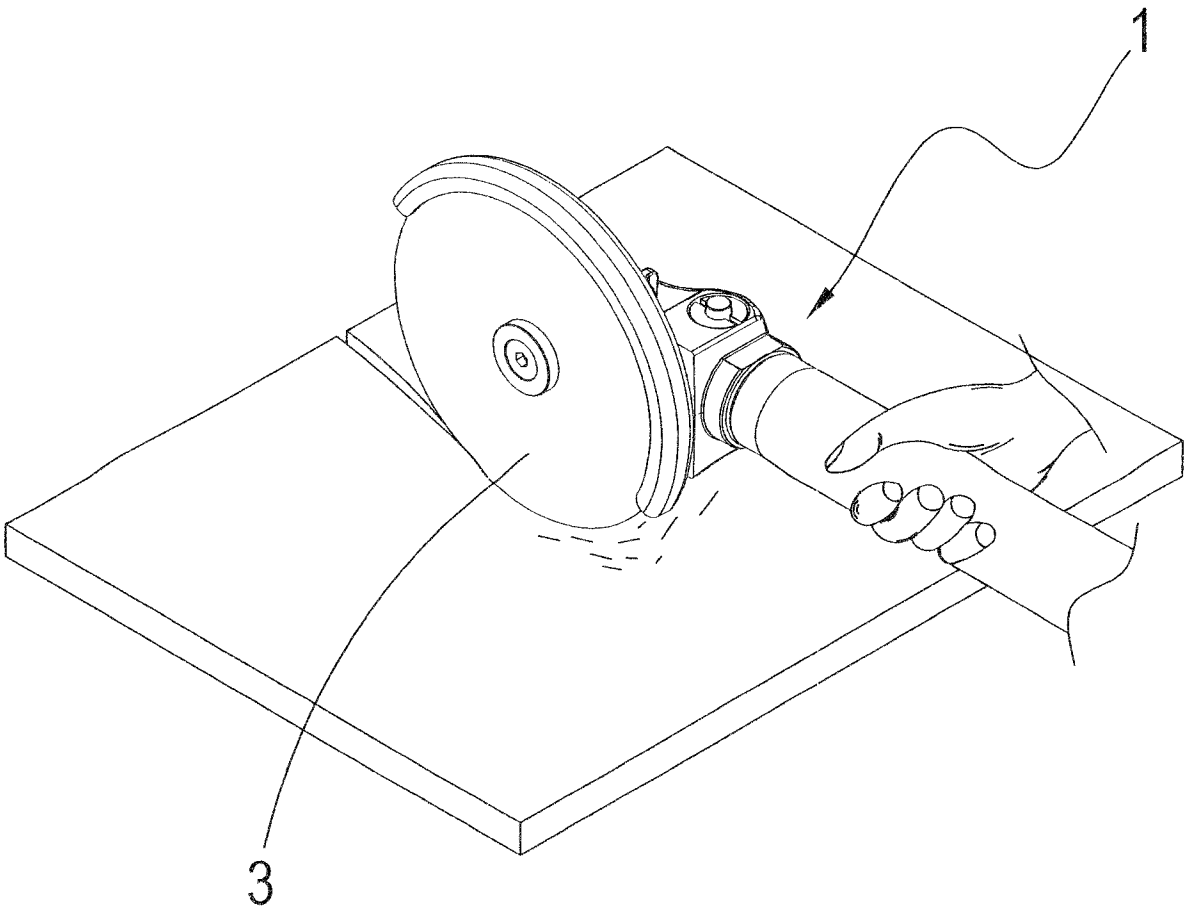
FIG. 7 shows a third working view of the embodiment of the present invention.
Figure 7A:
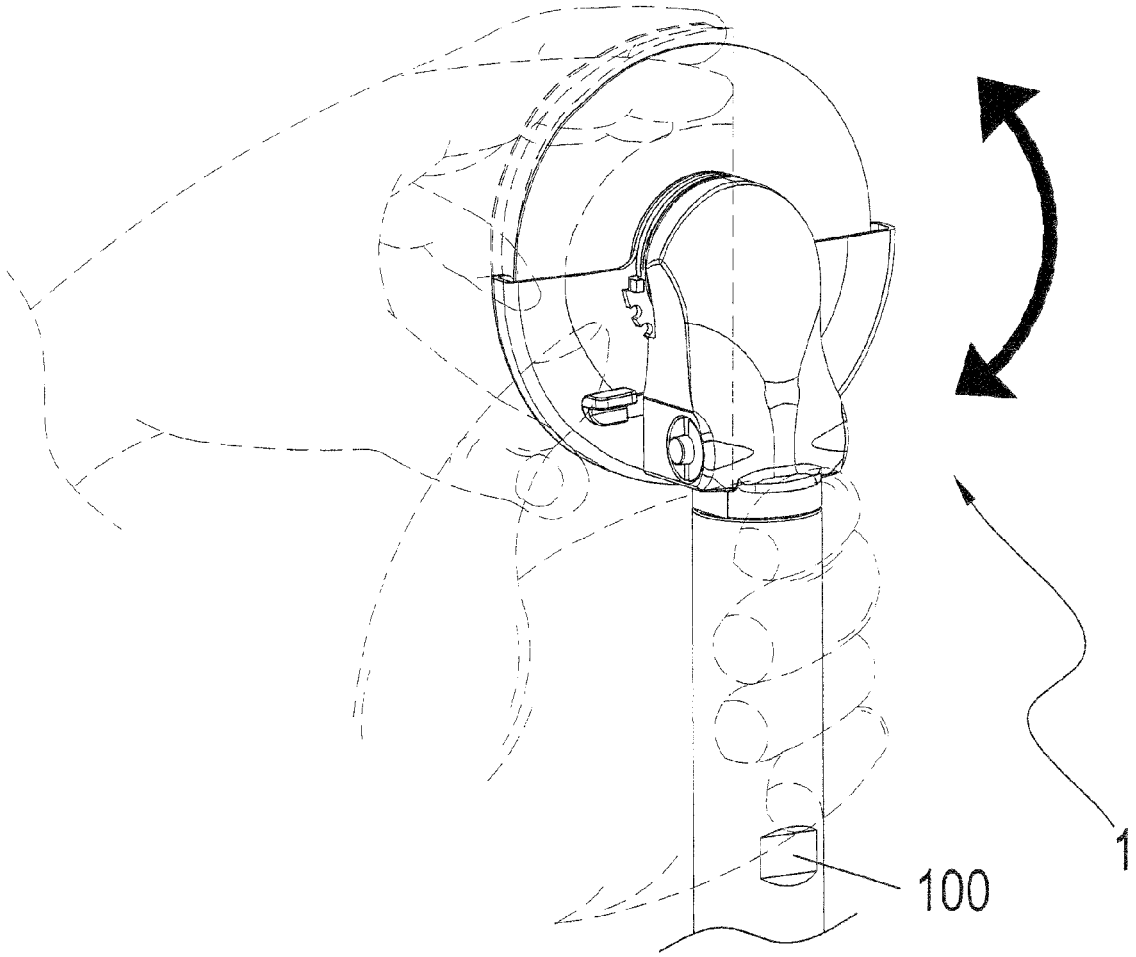
FIG. 7A shows a fourth working view of the embodiment of the present invention.

In operation, referring to FIGS. 5, 6, 6A, 7 and 7A, a grinding wheel 3 is mounted to the transmission portion 12. The protective hood 15, which is mounted to the coupling member 13, partly covers the grinding wheel 3. Thus, the uncovered portion of the grinding wheel 3 can be used in grinding or cutting external objects. The protective hood 15 is used for protecting a user from being damaged when breakage of the grinding wheel 3 occurs. In grinding or cutting operations, the user's hand may leave the button 100 to depress the operation portion 183 of the control member 18 to allow the control member 18 to be tilted about the bush 21, so that the protrusion 181 of the control member 18 can be disengaged from one of the indentations of the arcuately toothed member 151 (see FIG. 6 and FIG. 7A). Thereafter, the protective hood 15 together with the arcuately toothed member 151 can be freely rotated, in a limited range, around the coupling portion 13 so as to change the angle position of the protective hood 15. Thereafter, the user may release the operation portion 183 of the control member 18 to allow the control member 18 to be urged back by the coil spring 20. Thus, the control member 18 can be returned to its original position, where the protrusion 181 of the control member 18 can be engaged with one of indentations of the arcuately toothed member 151 again (see FIG. 6A), so that the protective hood 15 can be fixed at a new angle position, to facilitate the grinding or cutting operation, especially when the grinder is used in a working site having narrow space. Incidentally, the depressing threshold of the operation portion 183 to disengage the control member 18 from the arcuately toothed member 151 is dependent on the size of the bush 21, which can be properly selected to meet the requirements of an application. With the adjustable guard wheel structure of the present invention, the angle position of the protective hood can be adjusted promptly and conveniently. In addition, the slot 11 defined on the main body 1 can be engaged by the protrusion 153 of the arcuately toothed member 151 of the protective hood 15 to achieve the purpose of limiting the rotation of the protective hood 15. The present invention does not require an external tool to achieve the purpose of rotating the protective hood to a desired angle position. Also, the present invention is simple in structure and thus can achieve a compact design.

As a summary, the present invention has the following advantages over the prior art:

1. The present invention can adjust the protective hood 15 in a limited range without using an external tool.

2. The present invention employs the control member 18 between the protective hood 15, including the arcuately toothed member 15, and main body 1, to avoid a complicated and large structure design, as commonly seen in the conventional handheld grinder, so that the present invention can be used in a working site having narrow space.

3. To change the angle position of the protective hood 15, the user is required to leave the button 100 of the grinder to depress the operation portion 183 of the control member 18 by one hand, and thus the grinder can be stopped. Meanwhile, the protective hood 15 can be rotated by the other hand of the user. This feature can avoid the disadvantage of the conventional handheld grinder, wherein the user may adjust the protective hood by both hands without stopping the grinder, which may cause dangers.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A handheld grinder, comprising:

a main body defining an active space, a transmission portion provided on said main body, and a wheel guard structure, including:

a coupling member being coupled to said main body around said transmission portion;

a protective hood rotatably mounted to said coupling member at a center thereof, wherein said protective hood is provided with an engagement means defining a plurality of indentations, and allowed to be rotated about said coupling member at a predetermined angle; and a control member having a protrusion which can engage with one of said indentations of said engagement means, said control member including an end portion located in said active space of said main body, said end portion being insertedly connected to one end of a connecting pin located in said active space of said main body, the other end of said connecting pin being affixed to said main body, said connecting pin being fitted with a bush between its two ends and a coil spring around said bush, whereby said control member can cooperate with said coil spring and said bush to allow said protective hood to be fixed at an angle position when said control member is in normal condition, and to allow said control member to be tilted about said bush by a user to allow said control member to be clear of said engagement means, so that said protective hood can be rotated about said coupling member.

2. The handheld grinder of claim 1, wherein said engagement means is formed into an arcuately toothed member substantially at the center of said protective hood, said arcuately toothed member being formed with a plurality of teeth, said protrusion of said control member being capable of engaging with one indentation between two adjacent teeth of said arcuately toothed member.

3. The handheld grinder of claim 1, wherein said main body defines a slot near to said transmission portion to cooperate with said engagement means, so that rotation of said protective hood can be limited in a range.

4. The handheld grinder of claim 3, wherein said engagement means includes at least one protrusion which can engage with two sides of said slot of said main body, whereby rotation of said protective hood can be limited in a range.

5. The handheld grinder of claim 1, further comprising a snap ring for holding said protective hood onto said coupling member.

6. The handheld grinder of claim 5, wherein a first washer is provided between said snap ring and said protective hood.

7. The handheld grinder of claim 1, wherein a second washer is provided between said engagement means of said protective hood and said coupling member, said second washer being made of resilient material.

8. The handheld grinder of claim 1, wherein said end portion of said control member has a slanted end surface; said control member includes an operation portion, being located opposite to said end portion, to be depressed by a user.

* * * * *